US007565714B2

(12) United States Patent
Gueret

(10) Patent No.: US 7,565,714 B2
(45) Date of Patent: Jul. 28, 2009

(54) APPLICATOR, AND PACKAGING AND APPLICATOR DEVICE INCLUDING APPLICATOR

(75) Inventor: Jean-Louis H. Gueret, Paris (FR)

(73) Assignee: L'Oréal S.A., Paris (FR)

( * ) Notice: Subject to any disclaimer, the term of this patent is extended or adjusted under 35 U.S.C. 154(b) by 223 days.

(21) Appl. No.: 10/844,484

(22) Filed: May 13, 2004

(65) Prior Publication Data

US 2005/0008420 A1 Jan. 13, 2005
US 2005/0238409 A2 Oct. 27, 2005

Related U.S. Application Data

(60) Provisional application No. 60/475,775, filed on Jun. 5, 2003.

(30) Foreign Application Priority Data

May 14, 2003 (FR) ..... 03 05763

(51) Int. Cl.
*A46B 11/00* (2006.01)

(52) U.S. Cl. ..... 15/143.1; 15/172; 15/160; 15/167.3; 15/169; 401/129; 401/126

(58) Field of Classification Search ..... 15/143.1, 15/144.2, 144.1, 167.3, 169, 172, 160; 401/129, 401/126; 132/320
See application file for complete search history.

(56) References Cited

U.S. PATENT DOCUMENTS 571,367 A 11/1896 HIggins
643,803 A 2/1900 Schott
1,389,071 A 8/1921 Pessels
1,478,388 A 12/1923 Gray
1,602,551 A 10/1926 Ramsey
1,795,651 A 3/1931 Hunterr
1,943,804 A * 1/1934 Rummler ..... 401/119

(Continued)

FOREIGN PATENT DOCUMENTS

CH 155 730 7/1932

(Continued)

OTHER PUBLICATIONS

English language Derwent Abstract of FR 2 564 712, Nov. 29, 1985.

(Continued)

*Primary Examiner*—Shay L Karls
(74) *Attorney, Agent, or Firm*—Finnegan, Henderson, Farabow, Garrett & Dunner, L.L.P.

(57) ABSTRACT

An applicator for applying a substance to a keratinous surface may include a stem and an applicator member associated with a distal end of the stem. The stem may include a portion extending around at least part of the applicator member. The portion may have a proximal end and may extend from the proximal end toward the distal end of the stem. The proximal end of the portion may either be distal to a proximal end of the applicator member or located at substantially the same position as the proximal end of the applicator member. The portion may be configured to be deformed at least in part in response to deformation of the applicator member during application of the substance to the keratinous surface.

42 Claims, 3 Drawing Sheets

U.S. PATENT DOCUMENTS

| | | | | | |
|---|---|---|---|---|---|
| 1,999,642 | A | | 4/1935 | Shepherd | |
| 2,291,676 | A | | 8/1942 | Baker | |
| 2,296,139 | A | | 8/1942 | Blair | |
| 2,348,515 | A | | 5/1944 | Baumgartner | |
| 2,664,582 | A | | 1/1954 | Kammann | |
| 3,008,169 | A | | 11/1961 | Dearling | |
| 3,087,191 | A | | 4/1963 | Plunkett | |
| 3,195,544 | A | | 7/1965 | Politzer | |
| 3,271,807 | A | | 9/1966 | Cabot | |
| 3,393,962 | A | | 7/1968 | Andrews | |
| 3,592,202 | A | | 7/1971 | Jones | |
| 3,601,838 | A | | 8/1971 | Marx | |
| D270,669 | S | | 9/1983 | Cassai et al. | |
| 4,509,540 | A | | 4/1985 | Inagaki | |
| 4,520,526 | A | | 6/1985 | Peters | |
| 4,712,266 | A | * | 12/1987 | Yamaki | 15/167.1 |
| 4,796,647 | A | | 1/1989 | Gueret | |
| 4,927,281 | A | | 5/1990 | Gueret | |
| 4,972,858 | A | | 11/1990 | Beck et al. | |
| 4,998,315 | A | | 3/1991 | Pessis | |
| 5,020,551 | A | | 6/1991 | Guerret | |
| 5,238,011 | A | | 8/1993 | Gueret | |
| 5,357,647 | A | | 10/1994 | Gueret | |
| 5,491,865 | A | | 2/1996 | Gueret | |
| 5,575,579 | A | * | 11/1996 | Joulia | 401/119 |
| 5,888,005 | A | | 3/1999 | Gueret | |
| 5,909,976 | A | * | 6/1999 | Maeda | 401/129 |
| 6,033,143 | A | | 3/2000 | Gueret | |
| 6,059,473 | A | | 5/2000 | Gueret | |
| 6,341,912 | B1 | | 1/2002 | Gueret | |
| 7,086,116 | B2 | * | 8/2006 | Broecker et al. | 15/167.1 |
| 2002/0144702 | A1 | | 10/2002 | Gueret | |

FOREIGN PATENT DOCUMENTS

| | | | |
|---|---|---|---|
| DE | 425 254 | | 11/1924 |
| EP | 0 509 852 | | 10/1992 |
| FR | 1 052 211 | | 1/1954 |
| FR | 85 853 | | 9/1965 |
| FR | 2 564 712 | | 11/1985 |
| FR | 2 603 780 | | 3/1988 |
| GB | 2 082 553 | | 3/1982 |
| GB | 2 138 781 | A | 10/1984 |
| JP | 04-0099 | | 1/1929 |
| JP | 36-9009 | | 4/1961 |
| JP | 57-017610 | | 1/1982 |
| JP | 6-13714 | U | 2/1994 |
| JP | 8-38247 | | 2/1996 |
| JP | 11-244040 | | 9/1999 |

OTHER PUBLICATIONS

English language Derwent Abstract of JP 57-017610, Jan. 29, 1982.
English language abstract of JP 8-38247, Feb. 13, 1996.
English-language translation of JP 04-0099.
English-language translation of JP 36-9009.
English-language translation of JP 11-244040.
Notice of Opposition dated Jun. 17, 2008, in EP Pat. No. 1 477 083 B1, including English language translation of section entitled "Facts and Statement of Reasons."

* cited by examiner

APPLICATOR, AND PACKAGING AND APPLICATOR DEVICE INCLUDING APPLICATOR

This application claims the benefit of priority under 35 U.S.C. § 119(e) of U.S. provisional application No. 60/475,775, filed on Jun. 5, 2003.

The present invention relates to an applicator and/or a device for applying cosmetic products (e.g., care products). For example, the applicator and/or device may be used to apply cosmetic products such as those defined in Counsel Directive 93/35/EEC (European Economic Community) dated Jun. 14, 1993, which provides one non-limiting, exemplary definition of cosmetic products. (Other definitions are also possible.) Some examples of the invention may relate to an applicator and/or device for applying nail varnish and/or eyeliner.

In the field of devices for applying cosmetic products, for example, containers of nail varnish found on the market present a variety of content volumes, for example, generally ranging from 7 milliliters to 14 milliliters, and associated applicators include a stem with an applicator member at one end, in particular, in the form of a paintbrush. For containers having a relatively large capacity (e.g., 12 milliliters or more), the height of the container body renders it possible to use a stem that is relatively long. In contrast, for containers having a relatively small capacity, the height of the container body is generally smaller and the associated stem must be correspondingly shorter if it is desired to ensure that the bristles of the brush remain long enough to avoid reduced flexibility and/or reduced quality of application. A short stem, however, may be awkward to use and/or generally unattractive in appearance. On the other hand, the length of the bristles of the brush sometimes cannot be shortened without making the brush stiffer, which may result in forming streaks on the nail at the time of application.

There exists a need to obtain the benefit from an applicator enabling the substance to be applied appropriately, while still having a pleasant appearance, and being simple to manufacture and to use, even when associated with a receptacle having a relatively small capacity. The invention may, for example, seek to satisfy this need.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes an applicator for applying a substance to a keratinous surface. The applicator may include a stem and an applicator member associated with a distal end of the stem. The stem may include a portion extending around at least part of the applicator member. The portion may have a proximal end and may extend from the proximal end toward the distal end of the stem. The proximal end of the portion may either be distal to a proximal end of the applicator member or located at substantially the same position as the proximal end of the applicator member. The portion may be configured to be deformed at least in part in response to deformation of the applicator member during application of the substance to the keratinous surface.

According to some aspects, it may be possible to benefit from an applicator member that may be relatively flexible while giving the impression of having a stem of relatively long length, which may be advantageous from an aesthetic standpoint. For example, since the above-mentioned portion may be capable of deforming significantly in response to bending of the applicator member, the apparent length thereof may be smaller without losing flexibility, comfort, and/or accuracy of application.

As used herein, the term "apparent length" means the length of an element that can be viewed by a user of the applicator and/or device while in use, for example, the length of the stem outside of a closure cap when the applicator is viewed from the side (e.g., for embodiments having an applicator including a stem and a closure cap).

According to another aspect, the stem may include a distal part and a proximal part joined to one another, and the distal part may include the portion of the stem. According to a further aspect, for example, the proximal part may be configured to be substantially undeformed during application of the substance to the keratinous surface.

In still another aspect, when the applicator member is constituted by a paintbrush (e.g., having a bundle of bristles substantially parallel to one another), for example, bristles of the paintbrush may define an apparent length of about 10 millimeters and may result in substantially the same performance and comfort in application as a conventional applicator in which the apparent length of the bristles is greater (e.g., from about 10% to about 300% greater (e.g., having an apparent length of about 17 millimeters)).

In yet another aspect, the applicator member may define an apparent length, wherein the apparent length ranges from about 2 millimeters to about 7 millimeters. For example, the applicator member may define an apparent length, wherein the apparent length is about 5 millimeters.

According to another aspect, the portion may contribute to determining the way in which the applicator member deforms during application, for example, such that the user can achieve greater accuracy (e.g., when following the outline of the nails).

In still a further aspect, the stem may include a distal part and an adjacent proximal part. The distal part may include the portion and the distal part and the adjacent proximal part may be fitted to one another. For example, the distal part and the proximal part may be fitted to one another via at least one of snap-fastening, force fitting, adhesive, and heat-sealing. According to some aspects, the distal part may include the portion and the distal part may be overmolded onto the adjacent proximal part of the stem.

According to a further aspect, the proximal part and the distal part may include the same material. In some aspects, the proximal part and the distal part may include, at least in part, two respective different materials.

In still another aspect, the portion may at least partially include an elastomer material. In another aspect, the distal part may at least partially include an elastomer material.

According to yet another aspect, the portion at least partially comprises a material selected from one of silicone, ethylene-propylene diene monomer (EPDM), polyurethane (PU), styrene-isoprene-styrene (SIS), styrene-ethylene-butaline-styrene (SEBS), styrene-butadiene-styrene block copolymer (SBS), ethylene vinyl acetate copolymer (EVA), block polyether, and polyester. In some aspects, the portion may at least partially include other materials.

In still another aspect, the stem may include a second portion. The second portion may at least partially include a material selected from one of high density polyethylene (PEHD), low density polyethylene (PELD), polypropylene (PP), polyacetal (POM), polyamide (PA), polyethylene terephthalate (PET), and polybutaline terephthalate (PBT).

According to yet a further aspect, the stem may include at least one slot extending over at least a fraction of a length of the portion. According to some aspects, such a slot may render the portion more deformable, and for example, the slot may render it possible to use a material that is less flexible.

In still another aspect, the portion may extend around at least part of the applicator member in a substantially continuous manner. In a further aspect, the portion may extend around at least part of the applicator member in a discontinuous manner. For example, the portion may surround the applicator member circumferentially, either completely or in part.

In yet another aspect, the portion may optionally contact the applicator member.

According to another aspect, the portion may include two openings located opposite one another. For example, the two openings may extend over at least a fraction of the length of the portion (e.g., beginning at the free end of the portion). The openings may serve to improve the deformability of the portion and/or may allow the applicator member to deform in a certain manner during application, for example, when the applicator member is in the form of a paintbrush.

In still another aspect, the applicator member may extend at least partially outside the portion, and the applicator member may, for example, extend mostly outside the portion. For example, according to some aspects, the length of the part of the applicator member that is engaged inside the portion may correspond to at least about one-fourth or at least about one-third of the total length of the applicator member (e.g., when the applicator member is a bundle of bristles).

According to yet another aspect, the applicator member may be fastened to the proximal part. In still another aspect, the applicator member may be fastened to the distal part.

In another aspect, the portion may be more easily deformable in at least one preferred direction of deformation.

In still a further aspect, the portion, in the absence of deformation of the applicator member, may define an outside cross-section that is not constant. For example, the portion may be defined by a wall that tapers toward a free end of the stem.

In yet another aspect, the portion may define at least one inside cross-section and at least one outside cross-section, wherein at least one of the inside cross-section and the outside cross-section defines a shape selected from circular, non-circular, oblong, oval, elliptical, polygonal, square, rectangular, kidney-shaped, crenellated, star-shaped, and a shape having at least one groove.

In yet another aspect, the portion may include a wall surrounding at least the part of the applicator member, the wall having a thickness ranging from about 0.3 millimeter to about 0.8 millimeter. According to some aspects, the wall thickness may be substantially constant.

According to another aspect, the portion may include a wall surrounding at least the part of the applicator member, the wall having a thickness that varies. For example, in still a further aspect, the wall thickness may vary in a longitudinal direction (e.g., the wall thickness may decrease approaching a distal end of the portion).

In yet another aspect, the length of the portion may range from about 1 millimeter to about 12 millimeters. For example, the length of the portion may range from about 2 millimeters to about 8 millimeters.

According to another aspect, the stem defines a length, and, over at least a fraction of the stem length, the stem may include at least one groove. For example, the at least one groove may include two grooves positioned opposite one another. In another aspect, the portion defines a length, and the at least one groove may extend over a major fraction of the length of the portion. In a further aspect, the portion defines a length, and the at least one groove may extend over at least substantially the entire length of the portion.

In yet a further aspect, the applicator member may include at least one of a bundle of bristles, a felt portion, a coating of flocking, and a foam. In still another aspect, the applicator member may include a bundle of bristles substantially parallel to one another. For example, the applicator member may include a bundle of bristles forming a paintbrush having a cross-section that may either be substantially flat or substantially round. According to a further aspect, the applicator member may include at least one flocked tip.

According to yet another aspect, the applicator member may include bristles that may include natural and/or synthetic material(s), that may be hollow and/or solid, that may define a capillary groove(s), that may define a polygonal cross-section, and/or that may define a substantially circular cross-section. The applicator member may include a mixture of bristles of differing types and/or differing shapes.

In still a further aspect, the applicator may include a handle member, wherein a proximal part is joined to the handle member at an end opposite a distal part. For example, the handle member may be configured to be fastened to a receptacle (e.g., the handle member may include a screw thread configured to fasten the handle member to a receptacle).

According to another aspect, a packaging and applicator device (e.g., for packaging and applying a substance to a keratinous surface) may include an applicator and a receptacle containing the substance. For example, in still a further aspect, the substance may be at least one of a cosmetic product and a care product.

In yet another aspect, the applicator may be configured to be releasably fastened to the receptacle. According to a further aspect, the receptacle may include a wiper.

According to still a further aspect, the substance may include a substance configured to be applied to nails. For example, the substance may be a nail varnish.

In yet another aspect, the capacity of the receptacle may range from about 2 milliliters to about 12 milliliters, for example, from about 5 milliliters to about 9 milliliters (e.g., about 7 milliliters). In another aspect, the capacity of the receptacle may be about 2 milliliters.

According to another aspect, the substance may include an eyeliner. For example, the applicator member may define a paintbrush or something other than a paintbrush, for example, an applicator member including a felt tip, a tip of flocked plastics material, and/or a foam tip. In some examples, due to the presence of the portion, the sensation of hardness may be reduced during application to the eye region.

In still another aspect, a method of manufacturing an applicator may include providing a stem with a sleeve configured to slide along the stem, positioning the sleeve in a waiting position allowing access to one end of the stem, securing an applicator member to the one end of the stem, and causing the sleeve to slide along the stem toward the distal end of the stem so as to cause the sleeve to at least partially cover the applicator member.

According to another aspect, at least a fraction of the sleeve may be arranged so as to be capable of deforming at least partially in response to deformation of the applicator member during application.

In still another aspect, the sleeve may be configured to be held in place on the stem via at least one of snap-fastening and friction at the end of its sliding toward the distal end of the stem.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate exemplary embodiments of the invention and, together with the description, serve to explain some principles of the invention. In the drawings, FIG. 1 is a schematic, partial cross-section view of one embodiment of a device for applying a product to a keratinous surface;

Reference will now be made in detail to some possible embodiments of the invention, examples of which are illustrated in the accompanying drawings. Wherever possible, the same reference numbers are used in the drawings and the description to refer to the same or like parts.

Figure 1:
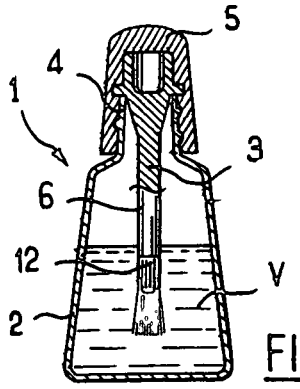

FIG. 1 depicts an exemplary embodiment of a packaging and applicator device 1 that includes a receptacle 2 and an applicator 3, which may be releasably fastened to the receptacle 2. For example, the top of the receptacle 2 includes a neck 4 having an exterior thread onto which it is possible to screw a closure cap 5, which may also serve as a handle member for the applicator 3.

Figure 2:
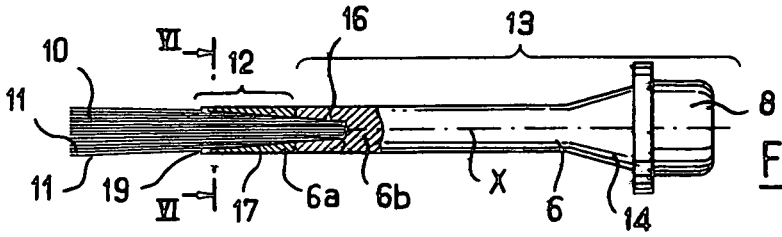
FIG. 2 is a schematic, partial cross-section view of one embodiment of an applicator for applying a product to a keratinous surface.

The receptacle 2 may, for example, contain nail varnish V, but it would not go beyond the ambit of the present invention for the receptacle 2 to contain some other substance. The applicator 3 depicted in this exemplary embodiment includes a stem 6, for example, as shown in FIG. 2. The stem 6 carries at one end (e.g., a proximal end), an endpiece 8, which may render it possible to fasten stem 6 to the closure cap 5, and at its opposite end (e.g., a distal end) an applicator member 10 (e.g., a bundle of bristles 11, which may constitute, for example, a paintbrush).

For example, the stem 6 may include a distal part 6*a* and a proximal part 6*b* formed from different materials, and the proximal part 6*b* may itself include, for example, a circularly cylindrical part about an axis X. The circularly cylindrical part may be connected to the endpiece 8, for example, via a flaring part 14. The end of the proximal part 6*b* adjacent to the distal part 6*a* includes a housing 16, which may have a bundle of bristles 11 fixed to the end thereof, for example, via stapling. The bundle may be folded in two, for example, and fixed halfway along its length by a staple, which is placed in the end of the housing 16. The distal part 6*a* may define a housing 17 about the axis X, and the housing may be open at both axial ends, with the applicator member 10 passing therethrough.

A portion 12 of the applicator member may be defined by a portion of the stem 6, which extends around the applicator member 10 (not necessarily in an uninterrupted manner) and which can deform at least in part in response to deformation of the applicator member 10 during application. In the example shown, the portion 12 extends over the entire length of the distal part 6*a*. The remainder of the stem 6 defines a second portion 13. This second portion 13 may be entirely non-deformable, non-deformable in part only (e.g., partially deformable), or possibly even entirely deformable. For example, bristles 11 may be fixed in the second portion 13, for example, as shown in FIG. 2.

Figure 2A:
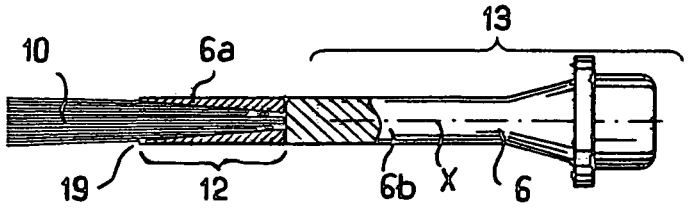
FIG. 2A is a schematic, partial section view of another embodiment of an applicator for applying a product to a keratinous surface.

As shown in FIG. 2, a proximal end of the portion 12 is distal to a proximal end of the applicator member 10, and the portion 12 extends from its proximal end toward a distal end of the stem 6. Alternatively, as described below, the proximal end of the portion 12 of the stem 6 may be located at substantially the same position as the proximal end of the applicator member 10 (see, e.g., FIG. 2A).

Figure 6:
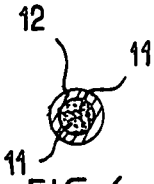
FIG. 6 is a section view along line VI-VI of FIG. 2.

In the exemplary embodiment depicted in FIG. 2, the wall of the portion 12 tapers towards the free end 19 (e.g., distal end) of the stem 6, and the portion 12 presents inside and outside cross-sections that are both circular, for example, as depicted in FIG. 6. The portion 12 may also define other shapes, as described in more detail below.

In the exemplary embodiment shown in FIG. 2, the distal part 6*a* is formed from a plastics material that is more flexible than the material from which the proximal part 6*b* is formed. For example, the distal part 6*a* may be formed from an elastomer, which may be overmolded to the end of the proximal part 6*b*, and, for example, it may be formed from a thermoplastic elastomer. According to some embodiments, the stem 6 may include at least one rigid portion.

According to some exemplary embodiments, the applicator 3 may be formed as follows. First, the stem 6 may be molded by molding the proximal part 6*b* and overmolding the distal part 6*a* onto the proximal part 6*b*. Thereafter, for example, the applicator member 10 (e.g., a bundle of bristles 11) may be fixed on the proximal part 6*b*.

Figure 3:
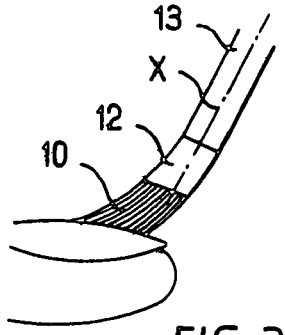
FIG. 3 is a schematic perspective view showing an example of using an applicator to apply a substance to a keratinous surface.

As schematically depicted in FIG. 3, the applicator member 10 may flex as it contacts the surface (e.g., a nail surface) onto which the substance is to be applied during use, and the portion 12 may accompany the deformation of the applicator member 10 at least to some extent because of its own deformability, whereas the second portion 13 may present a shape that is substantially unchanged.

The portion 12 may contribute to user comfort during application of substance and may render it possible for the apparent length of the stem 6 (e.g., the length of the stem 6 outside the closure cap 5 when the applicator 3 is viewed from the side) to be long enough to be aesthetically pleasing to the user. This apparent length may also render it easier to apply the substance accurately by ensuring that during application, the closure cap 5 does not substantially impede observation of the surface onto which the substance is to be applied. The portion 12 may also enable the applicator member 10 (e.g., bundle of bristles 11) to behave as though the applicator member 10 is longer than it appears to be because the portion 12 can, at least to some extent, accompany the deformation of the fraction of the applicator member 10, which extends inside the housing 17. The portion 12 may deform in bending (i.e., it may deform so that its longitudinal axis becomes curvilinear instead of coinciding with the axis X). The portion 12 may also deform by changing in cross-section (e.g., by exhibiting a flatter cross-section), thereby encouraging, for example, the bristles 11 of a bundle to spread out, for example, into a fan-like shape. Once application of the substance has ended, the portion 12 may return to its initial shape via, for example, shape memory due at least in part to its own elasticity. For example, the longitudinal axis of the portion 12 may revert to rectilinear and coincide with the axis X.

Figure 4:
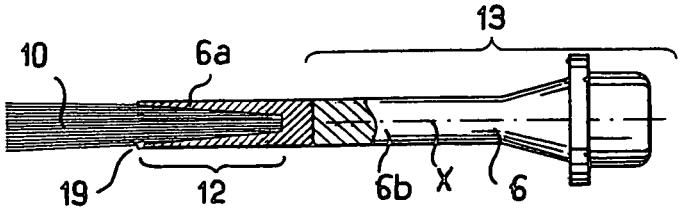
FIG. 4 is a schematic, partial cross-section view of another embodiment of an applicator.

Various modifications may be applied to the applicator 3 without going beyond the ambit of the present invention. For example, in the exemplary embodiment depicted in FIG. 4, applicator member 10 may be implanted entirely in the distal part 6*a* of the stem 6. In this example, the portion 12 extends over only a fraction of the length of the distal part 6*a*, which, for example, may be formed entirely from elastomer material. The second portion 13 extends at least in part over the distal part 6*a*, which, for example, may be formed from elastomer.

Figure 5:
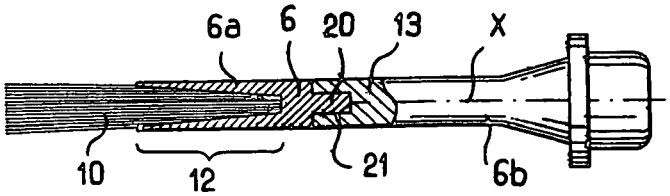
FIG. 5 is a schematic, partial cross-section view of a further embodiment of an applicator.

The distal part 6*a* and the proximal part 6*b*, when they are formed from different materials, may be assembled together in various ways other than by overmolding material one material over the other. For example, in the exemplary embodiment depicted in FIG. 5, the distal part 6*a* and the proximal part 6*b* may be assembled together by the engagement of complementary shapes (e.g., by making a male shape 20 at one end of the distal part 6*a*, which is configured to engage in a housing 21 having a complementary shape in the proximal part 6*b*).

Figure 7:
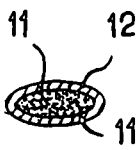
FIG. 7 is a schematic cross-section view of a portion of one embodiment of an applicator.
Figure 8:
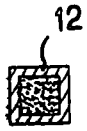
FIG. 8 is a schematic cross-section view of a portion of another embodiment of an applicator.
Figure 9:
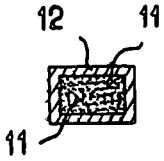
FIG. 9 is a schematic cross-section view of a portion of a further embodiment of an applicator.
Figure 10:
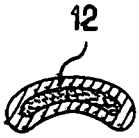
FIG. 10 is a schematic cross-section view of a portion of another embodiment of an applicator.
Figure 11:
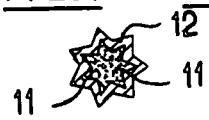
FIG. 11 is a schematic cross-section view of a portion of a further embodiment of an applicator.
Figure 12:
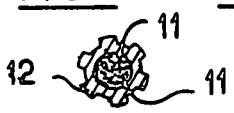
FIG. 12 is a schematic cross-section view of a portion of another embodiment of an applicator.
Figure 13:
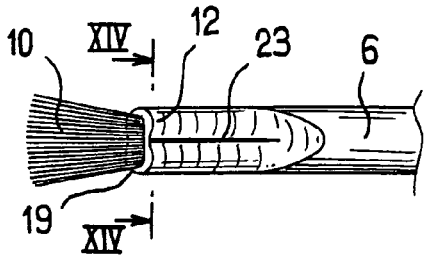
FIG. 13 is a schematic, partial perspective view of one embodiment of an applicator.

In the exemplary embodiment depicted in FIG. 2, the portion 12 has a wall of circular cross-section surrounding the applicator member 10. When, for example, application of the substance not occurring, the wall may present, in some embodiments, a cross-section that is not circular (e.g., the cross-section may be substantially oval, as shown in FIG. 7). According to some embodiments, the portion 12 may also define a cross-section having a polygonal shape (e.g., square or rectangular shape), as shown in FIGS. 8 and 9; a kidney shape, as shown in FIG. 10; a star shape, as shown in FIG. 11, and/or a crenellated shape, as shown in FIG. 12.

For example, the stem 6 may be formed having a longitudinal groove 23, which may extend over all or part of the length of the stem 6, for example, over a fraction of the length thereof beginning from the stem's free end 19 (e.g., distal end). For example, the groove 23 may extend only over the second portion 12 (e.g., over a major fraction thereof), and/or over at least some of the distal part 6*a*.

Figure 14:
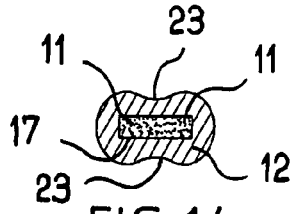
FIG. 14 is a section view along line XIV-XIV of FIG. 13.

In the exemplary embodiment depicted in FIG. 14, the stem 6 (e.g., the portion 12 of the stem 6) may define inside and outside cross-sections that do not define the same shape. For example, the stem 6 may define an outside cross-section that is generally oblong in shape having two opposite grooves 23 (such as depicted in FIG. 14) over a fraction of the stem's 6 length starting from its free end 19 (e.g., the stem's 6 distal end). The inside cross-section may be rectangular, for example, such that the wall of the portion 12 defines variations in thickness around the housing 17 through which the applicator member 10 (e.g., bundle of bristles 11) passes. The grooves 23 may be used for channeling substance running along the stem 6 after the applicator 3 has been withdrawn from the receptacle 2, so that the substance flows toward the free end 19 into one or more predefined zones of the applicator member 10 (e.g., into a central region thereof), thereby improving comfort of application and/or accuracy in applying substance (e.g., makeup).

Figure 15:
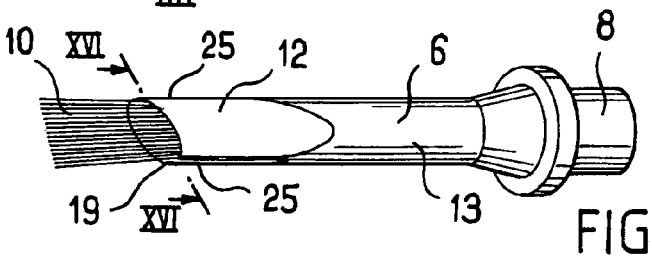
FIG. 15 is a schematic, partial perspective view of another embodiment of an applicator.
Figure 16:
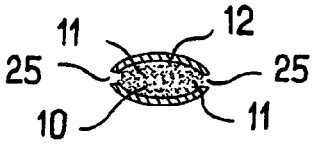
FIG. 16 is a section view along line XVI-XVI of FIG. 15.

In the exemplary embodiments depicted in FIGS. 15 and 16, the stem 6 includes two diametrically opposite side openings 25 extending from the stem's 6 free end 19. The openings 25 may extend, for example, over a major fraction of the portion 12. The openings 25 may enable the bristles 11 of an applicator member 10 (e.g., when the applicator member 10 includes a bundle of bristles 11) to spread out in a fan-like shape during application of substance by passing through the openings 25.

According to some exemplary embodiments, the shape of the cross-section of the portion 12 may define at least one preferred direction in which the portion 12 may deform. For example, a cross-section defining an oblong shape may bend more easily about an axis, which is parallel to a major axis of the oblong shape. A kidney-shaped cross-section may give the applicator member 10 a gutter shape that enables it to fit more easily around the convex shape of a nail.

Figure 17:
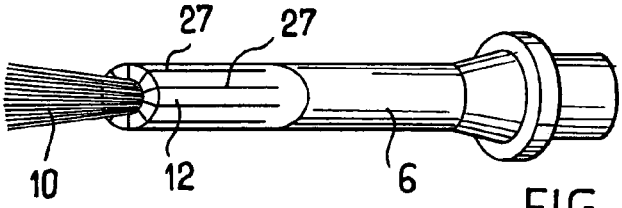
FIG. 17 is a schematic, partial perspective view of a further embodiment of an applicator.

According to some exemplary embodiments, the stem 6 may be formed with at least one slot for improving the deformability of at least a fraction of the length of the stem 6 (e.g., the deformability of the portion 12). For example, FIG. 17 shows an exemplary embodiment of a stem 6 that includes a plurality of longitudinal slots 27 having with contacting edges. The slots 27 may be distributed uniformly around the perimeter (e.g., circumference) of the portion 12 and may pass through the entire thickness of the portion's 12 wall. In some embodiments, the slots 27 may extend thorough only a fraction of the thickness of the wall (e.g., starting from the wall's outside surface). The slots 27 may also have edges spaced from one another.

Figure 18:
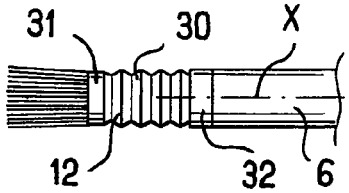
FIG. 18 is a schematic, partial elevation view of a further embodiment of an applicator.

In the exemplary embodiment depicted in FIG. 18, the stem 6 may be formed with at least one bellows-shaped portion 30 extending between regions 31 and 32 and may be capable of, for example, bending about at least one axis perpendicular to the longitudinal axis X.

Figure 30:
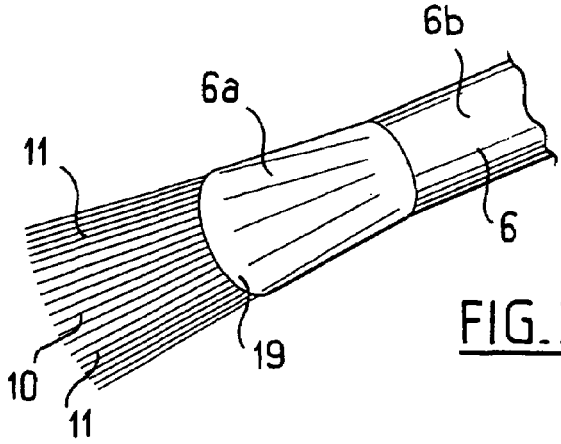
FIG. 30 is a partial schematic view of another embodiment of an applicator.

In the exemplary embodiment depicted in FIG. 30, the distal part 6*a* of the stem 6 defines a duck-bill shape. The end (e.g., the proximal end) of the distal part 6*a*, which joins the proximal part 6*b* of the stem 6 may be substantially circular in shape, and the free end 19 (e.g., distal end) of the distal part 6*a* may define a flattened shape.

Figure 31:
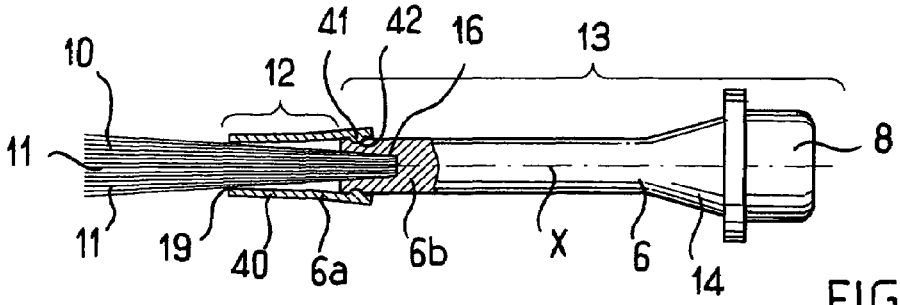
FIG. 31 is a schematic, partial cross-section view of a further embodiment of an applicator in a first configuration.
Figure 32:
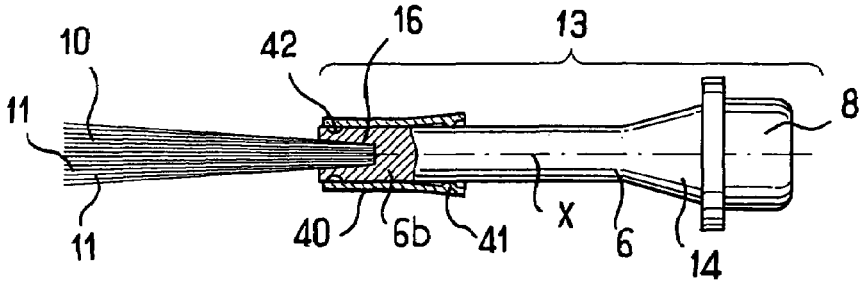
FIG. 32 is a schematic, partial cross-section view of the embodiment of FIG. 31 in a second configuration.

In the exemplary embodiment depicted in FIG. 31, the stem 6 defines a distal part 6*a* including a sleeve 40 configured to slide along the proximal part 6*b* of the stem 6. FIG. 32 depicts the sleeve 40 in a waiting position on the proximal part 6*b* of the stem 6, allowing easy access to the housing 16, for example, for fastening the applicator member 10 (e.g., a bundle of bristles 11) therein. Once the applicator member 10 has been installed into the stem 6, the sleeve 40 may be moved relative to the proximal part 6*b* of the stem 6 so as to surround at least a fraction of the applicator member 10. The sleeve 40 may be held in its final position on the proximal part 6*b* of the stem 6, for example, via snap-fastening (e.g., via an annular bead 41 that engages in an annular groove 42 formed in the end of the proximal part 6*b* of the stem 6).

In the exemplary embodiments depicted in FIGS. 15, 17, and 18, for example, the deformability of the portion 12 may be obtained by virtue of the presence of openings 25, slots 27, and/or a bellows 30, and the portion 12 may exhibit sufficient deformability without forming the portion 12 from an elastomer material. For example, the portion 12 may be formed from, where appropriate, the same material as the remainder of the stem 6. Nevertheless, in order to benefit from even greater deformability, the portion 12 may be formed at least in part from an elastomer material.

Figure 19:
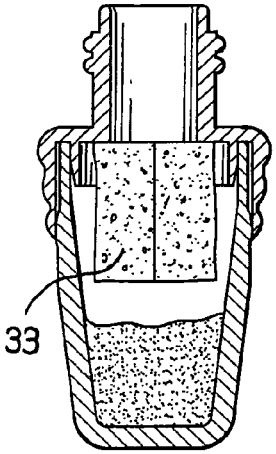
FIG. 19 is a schematic cross-section view of one part of another embodiment of a device for applying a product to a keratinous surface.
Figure 33:
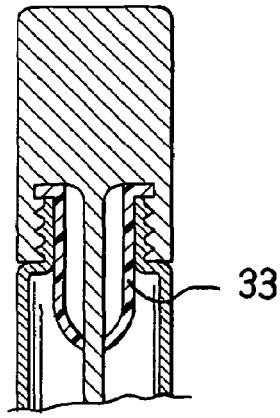
FIG. 33 is a schematic cross-section view of a portion of a further embodiment of a device.

According to some exemplary embodiments of the invention, the invention may be applicable not only in the field of applying nail varnish, but may be more generally applicable to the field of applying substance (e.g., makeup), for example, the field of applying a substance to the eyelids (e.g., the field of applying an eyeliner). The substance may be contained, for example, in a receptacle 2 that may include a wiper member 33, as shown in FIGS. 19 and 33, that serves to wipe an applicator member 10 as it leaves the receptacle 2. The wiper member 33 may be formed from, for example, pierced foam (as shown in FIG. 19) and/or from an elastomer sleeve (as shown in FIG. 33).

Figure 20:
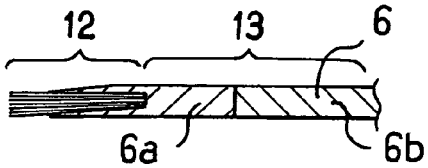
FIG. 20 is a schematic cross-section view of a further embodiment of an applicator.
Figure 21:
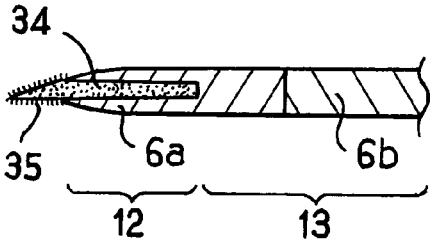
FIG. 21 is a schematic, partial cross-section view of another embodiment of an applicator.
Figure 22:
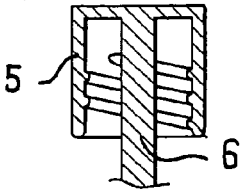
FIG. 22 is a schematic, partial cross-section view of a further embodiment of an applicator.

According to some exemplary embodiments, when used with an eyeliner, the applicator member 10 may include a paintbrush, (e.g., as shown in FIG. 20) and/or any other applicator member 10 (e.g., a felt tip 34 formed from a foam and/or other material (e.g., a solid plastics material, such as an elastomer)). The applicator member 10 may include a flocked tip 35 (e.g., as shown in FIG. 21). The applicator member 10 may be structured in still other ways, such as, for example, the stem 6 may be formed integrally with a closure cap 5 (e.g., as shown in FIG. 22).

In the exemplary embodiments of FIGS. 4, 5, 20, and 21, the proximal end of the portion 12 may be is located at substantially the same position as the proximal end of the applicator member, and the portion 12 extends from its proximal end toward a distal end of the stem.

Figure 24:
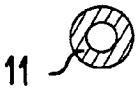
FIG. 24 is a schematic cross-section view of a further example of a bristle.
Figure 23:
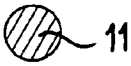
FIG. 23 is a schematic cross-section view of one example of a bristle.
Figure 25:
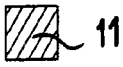
FIG. 25 is a schematic cross-section view of another example of a bristle.
Figure 26:
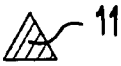
FIG. 26 is a schematic cross-section view of a further example of a bristle.
Figure 27:
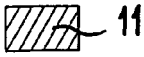
FIG. 27 is a schematic cross-section view of another example of a bristle.
Figure 28:
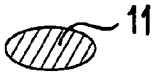
FIG. 28 is a schematic cross-section view of a further example of a bristle.
Figure 29:
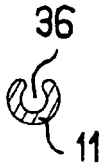
FIG. 29 is a schematic cross-section view of another embodiment of a bristle.

In exemplary embodiments having an applicator member 10 that includes a bundle of bristles 11, the bristles 11 may define a variety of cross-sections, such as, for example, the cross-sections shown in FIGS. 24 though 29. For example, at least one of the bristles 11 may be solid (e.g., as shown in FIG. 23); hollow (e.g., as shown in FIG. 24); polygonal in cross-section (e.g., as shown in FIGS. 25 through 27 (e.g., square (FIG. 25), triangular (FIG. 26), and/or rectangular FIG. 27))); oval (e.g., as shown in FIG. 28), and/or at least one bristle 11 may include at least one capillary groove 36 (e.g., as shown in FIG. 29). At least one of the bristles may be formed from natural and/or synthetic materials (e.g., using a mixture of bristles 11 having differing shapes and/or formed from differing materials).

The applicator and/or device according to some exemplary embodiments of the invention may be used to apply cosmetic products and/or care products, such as make-up products, dermatological substances, and/or pharmaceutical compositions used for treating and/or changing the appearance and/or scent of a keratinous surface. However, in its broadest aspects, the present invention could be used to apply many other substances.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A packaging and applicator device for applying a substance to a keratinous surface, the device comprising:

a receptacle containing the substance; and an applicator for applying the substance to a keratinous surface, the applicator comprising a stem; and an applicator member associated with a distal end of the stem, the applicator member comprising a bundle of bristles, wherein the stem comprises a portion extending around at least part of the applicator member, wherein the portion has a proximal end and extends from the proximal end toward the distal end of the stem, wherein the proximal end of the portion is either distal to a proximal end of the applicator member, being separated from the proximal end of the applicator member in the distal direction with respect to the proximal end of the applicator member, or located at substantially the same position as the proximal end of the applicator member, wherein the portion is configured to be deformed at least in part in response to deformation of the applicator member during application of the substance to the keratinous surface, wherein the portion is configured to contact the applicator member in absence of deformation of the applicator member, wherein the substance comprises a nail varnish, wherein the portion defines an inside cross-section defining a non-circular shape, and wherein the bundle of bristles diverges toward the free end of the applicator member.

2. The device of claim 1, wherein the stem comprises a distal part and a proximal part joined to one another, and wherein the distal part comprises the portion of the stem.

3. The device of claim 2, wherein the proximal part is configured to be substantially undeformed during application of the substance to the keratinous surface.

4. The device of claim 2, wherein the proximal part and the distal part comprise the same material.

5. The device of claim 2, wherein the proximal part and the distal part comprise, at least in part, two respective different materials.

6. The device of claim 2, wherein the stem comprises a second portion, the second portion at least partially comprising a material selected from one of PEHD, PELD, PP, POM, PA, PET, and PBT.

7. The device of claim 2, wherein the applicator member is fastened to the proximal part.

8. The device of claim 2, wherein the applicator member is fastened to the distal part.

9. The device of claim 2, further comprising a handle member, wherein the proximal part is joined to the handle member at an end opposite the distal part.

10. The device of claim 9, wherein the handle member is configured to be fastened to the receptacle.

11. The device of claim 9, wherein the handle member comprises a screw thread configured to fasten the handle member to a receptacle.

12. The device of claim 1, wherein the stem comprises a distal part and an adjacent proximal part, and wherein the distal part comprises the portion and the distal part is overmolded onto the adjacent proximal part of the stem.

13. The device of claim 1, wherein the stem comprises a distal part and an adjacent proximal part, and wherein the distal part comprises the portion and the distal part and the adjacent proximal part are fitted to one another.

14. The device of claim 13, wherein the distal part and the proximal part are fitted to one another via at least one of snap-fastening, force fitting, adhesive, and heat-sealing.

15. The device of claim 1, wherein the portion at least partially comprises an elastomer material.

16. The device of claim 1, wherein the portion at least partially comprises a material selected from one of silicone, EPDM, PU, SIS, SEBS, SBS, EVA, block polyether, and polyester.

17. The device of claim 1, wherein the stem comprises at least one slot extending over at least a fraction of a length of the portion.

18. The device of claim 1, wherein the portion extends around at least part of the applicator member in a substantially continuous manner.

19. The device of claim 1, wherein the portion extends around at least part of the applicator member in a discontinuous manner.

20. The device of claim 19, wherein the portion comprises two openings located opposite one another.

21. The device of claim 1, wherein the portion is more easily deformable in at least one preferred direction of deformation.

22. The device of claim 1, wherein the portion, in the absence of deformation of the applicator member, defines an outside cross-section that is not constant.

23. The device of claim 1, wherein the portion defines at least one outside cross-section, wherein the outside cross-section defines a shape selected from circular, non-circular, oblong, oval, elliptical, polygonal, square, rectangular, kidney-shaped, crenellated, star-shaped, and a shape having at least one groove.

24. The device of claim 1, wherein the portion comprises a wall surrounding at least the part of the applicator member, the wall having a thickness ranging from about 0.3 millimeter to about 0.8 millimeter.

25. The device of claim 1, wherein the portion comprises a wall surrounding at least the part of the applicator member, the wall having a thickness that varies.

26. The device of claim 25, wherein the wall thickness varies in a longitudinal direction.

27. The device of claim 26, wherein the wall thickness decreases approaching a distal end of the portion.

28. The device of claim 1, wherein the length of the portion ranges from about 1 millimeter to about 12 millimeters.

29. The device of claim 1, wherein the length of the portion ranges from about 2 millimeters to about 8 millimeters.

30. The device of claim 1, wherein the stem defines a length, and wherein, over at least a fraction of the stem length, the stem comprises at least one groove.

31. The device of claim 30, wherein the at least one groove comprises two grooves positioned opposite one another.

32. The device of claim 30, wherein the portion defines a length, and the at least one groove extends over a major fraction of the length of the portion.

33. The device of claim 30, wherein the portion defines a length, and the at least one groove extends over at least substantially the entire length of the portion.

34. The device of claim 1, wherein the applicator member defines an apparent length, wherein the apparent length ranges from about 2 millimeters to about 7 millimeters.

35. The device of claim 1, wherein the applicator member defines an apparent length, wherein the apparent length is about 5 millimeters.

36. The device of claim 1, wherein the applicator is configured to be releasably fastened to the receptacle.

37. The device of claim 36, wherein the receptacle comprises a wiper.

38. The device of claim 1, wherein the receptacle defines a capacity of about 2 milliliters.

39. A method of manufacturing the device of claim 1, the method comprising:

providing a stem with a sleeve configured to slide along the stem, positioning the sleeve in a waiting position allowing access to one end of the stem;

securing the applicator member to the one end of the stem; and causing the sleeve to slide along the stem toward the distal end of the stem so as to cause the sleeve to at least partially cover the applicator member.

40. The method of claim 39, wherein the sleeve is configured to be held in place on the stem via at least one of snap-fastening and friction at the end of its sliding toward the distal end of the stem.

41. A packaging and applicator device for applying a substance to a keratinous surface, the device comprising:

a receptacle containing the substance; and an applicator for applying the substance to a keratinous surface, the applicator comprising a stem; and an applicator member associated with a distal end of the stem, the applicator member comprising a bundle of bristles, wherein the stem comprises a portion extending around at least part of the applicator member, wherein the portion has a proximal end and extends from the proximal end toward the distal end of the stem, wherein the proximal end of the portion is either distal to a proximal end of the applicator member, being separated from the proximal end of the applicator member in the distal direction with respect to the proximal end of the applicator member, or located at substantially the same position as the proximal end of the applicator member, wherein the portion is configured to be deformed at least in part in response to deformation of the applicator member during application of the substance to the keratinous surface, wherein the portion defines a tubular wall, wherein the substance comprises a nail varnish, wherein the portion defines an inside cross-section defining a non-circular shape, and wherein the bundle of bristles diverges toward the free end of the applicator member.

42. A packaging and applicator device for applying a substance to a keratinous surface, the device comprising:

a receptacle containing the substance; and an applicator for applying the substance to a keratinous surface, the applicator comprising a stem; and an applicator member associated with a distal end of the stem, the applicator member comprising a bundle of bristles, wherein the stem comprises a portion extending around at least part of the applicator member, wherein the portion has a proximal end and extends from the proximal end toward the distal end of the stem, wherein the proximal end of the portion is either distal to a proximal end of the applicator member, being separated from the proximal end of the applicator member in the distal direction with respect to the proximal end of the applicator member, or located at substantially the same position as the proximal end of the applicator member, wherein the portion is configured to be deformed at least in part in response to deformation of the applicator member during application of the substance to the keratinous surface, wherein the portion is overmolded on the stem, wherein the substance comprises a nail varnish, wherein the portion defines an inside cross-section defining a non-circular shape, and wherein the bundle of bristles diverges toward the free end of the applicator member.

* * * * *